US007390164B2

(12) United States Patent
Maejima et al.

(10) Patent No.: US 7,390,164 B2
(45) Date of Patent: Jun. 24, 2008

(54) FIXING STRUCTURE FOR FIXING ROTOR TO ROTOR SHAFT, AND TURBO MOLECULAR PUMP HAVING THE FIXING STRUCTURE

(75) Inventors: Yasushi Maejima, Yachiyo (JP); Yutaka Inayoshi, Yachiyo (JP); Shinji Kawanishi, Yachiyo (JP); Kou Sakurai, Yachiyo (JP); Hiroyuki Suda, Yachiyo (JP); Takeshi Akimoto, Yachiyo (JP)

(73) Assignee: Edwards Japan Limited (JP)

( * ) Notice: Subject to any disclaimer, the term of this patent is extended or adjusted under 35 U.S.C. 154(b) by 146 days.

(21) Appl. No.: 10/571,642

(22) PCT Filed: Aug. 27, 2004

(86) PCT No.: PCT/JP2004/012409

§ 371 (c)(1),
(2), (4) Date: Mar. 14, 2006

(87) PCT Pub. No.: WO2005/028874

PCT Pub. Date: Mar. 31, 2005

(65) Prior Publication Data

US 2007/0031270 A1 Feb. 8, 2007

(30) Foreign Application Priority Data

Sep. 16, 2003 (JP) ..... 2003-323378

(51) Int. Cl.
*F04D 19/04* (2006.01)
*F01D 1/36* (2006.01)

(52) U.S. Cl. ..... 415/90; 415/104; 415/216.1

(58) Field of Classification Search ..... 415/90, 415/104, 107, 216.1; 416/244 R, 244 A
See application file for complete search history.

(56) References Cited

U.S. PATENT DOCUMENTS

| | | | | |
|---|---|---|---|---|
| 4,609,332 | A * | 9/1986 | Miki et al. | 417/352 |
| 5,219,269 | A * | 6/1993 | Ikegami et al. | 415/55.1 |
| 6,599,084 | B1 * | 7/2003 | Schutz et al. | 415/90 |

FOREIGN PATENT DOCUMENTS

| | | |
|---|---|---|
| DE | 2202383 | 7/1973 |
| DE | 19915307 | 10/2000 |
| EP | 1318308 | 6/2003 |
| JP | 61210292 | 9/1986 |
| JP | 610210292 | 9/1986 |
| JP | 63071492 | 5/1988 |

* cited by examiner

*Primary Examiner*—Igor Kershteyn
(74) *Attorney, Agent, or Firm*—Adams & Wilks

(57) ABSTRACT

Provided are a fixing structure for fixing a rotor to a rotor shaft, in which the contact state of the contact surfaces of the rotor shaft and the rotor is stabilized to thereby maintain the rotation balance of the rotor shaft and the rotor, making it possible to prevent oscillation, and a turbo molecular pump having such a fixing structure. On the outer peripheral portion of the upper surface of a fastening portion (253), there is concentrically formed a rotor shaft (213) side contact surface (257) to be brought into contact with a rotor (103). Further, in the inner periphery of the contact surface (257), there is formed a spot facing portion (259) whose upper surface is recessed from the contact surface (257). Thus, when the rotor shaft (213) is fastened to the rotor (103), there is formed, at the portion where the spot facing portion (259) is formed, a gap (265) which has a depth corresponding to the depth of the spot facing portion (259) and which is between the contact surface (187) of the rotor (103) and the spot facing portion (259).

5 Claims, 13 Drawing Sheets

(a)

(b)

(c)

(a)

(b)

FIXING STRUCTURE FOR FIXING ROTOR TO ROTOR SHAFT, AND TURBO MOLECULAR PUMP HAVING THE FIXING STRUCTURE

CROSS-REFERENCE TO RELATED APPLICATIONS

This application is a U.S. national stage application of copending International Application No. PCT/JP2004/012409, filed Aug. 27, 2004, claiming a priority date of Sep. 16, 2003, and published in a non-English language.

TECHNICAL FIELD

The present invention relates to a fixing structure for fixing a rotor to a rotor shaft, and a turbo molecular pump having the fixing structure, and more particularly, to a fixing structure for fixing a rotor to a rotor shaft, in which the contact state of the contact surfaces of the rotor shaft and the rotor is stabilized to thereby maintain the rotation balance of the rotor shaft and the rotor, making it possible to prevent oscillation, and to a turbo molecular pump having such a fixing structure.

BACKGROUND ART

As a result of recent developments in electronics, there is a rapidly increasing demand for semiconductor devices such as memories and integrated circuits.

Such semiconductor devices are manufactured by doping semiconductor substrates of a very high purity with impurities to impart electrical properties thereto, by stacking together semiconductor substrates with minute circuit patterns formed thereon, etc.

In order to avoid the influences of dust in the air, etc., such operations must be conducted in a chamber in a high vacuum state. To evacuate this chamber, a vacuum pump is generally used; in particular, a turbo molecular pump, which is a kind of vacuum pump, is widely used since it involves little residual gas and allows maintenance with ease, etc. Further, a semiconductor manufacturing process involves a number of steps of causing various process gasses to act on a semiconductor substrate, and the turbo molecular pump is used not only to create a vacuum in the chamber but also to evacuate such process gases from the chamber.

Further, in an equipment such as an electron microscope, a turbo molecular pump is used to create a high vacuum state within the chamber of the electron microscope, etc. in order to prevent refraction, etc. of the electron beam due to the presence of dust or the like.

Such a turbo molecular pump is composed of a turbo molecular pump main body 100 for sucking gas from the chamber of a semiconductor manufacturing apparatus or the like, and a control device 200 for controlling the turbo molecular pump main body 100.

FIG. 9 shows the construction of a turbo molecular pump.

In FIG. 9, the turbo molecular pump main body 100 has an inlet port 101 formed at the upper end of a round outer cylinder 127. On the inner side of the outer cylinder 127, there is provided a rotor 103 in the periphery of which there are formed radially and in a number of stages a plurality of rotary vanes 102*a*, 102*b*, 102*c*, . . . formed of turbine blades for sucking and evacuating gases. The rotor 103 is a substantially cylindrical member with a ceiling, and a rotor shaft 113 is passed for fixation through the center of the rotor 103 from the inner side thereof. The structure of the portion where the rotor shaft 113 and the rotor 103 are fixed to each other will be described in detail below.

Further, the rotor shaft 113 is supported in a levitating state and controlled in position by, for example, a so-called five-axis control magnetic bearing. A cylindrical main shaft portion 151 of the rotor shaft 113 is formed of a high magnetic permeability material (such as iron), and is attracted by the magnetic force of an upper radial electromagnet 104 and a lower radial electromagnet 105.

The upper radial electromagnet 104 includes four electromagnets arranged in pairs in the X-axis and the Y-axis. In close proximity to and in correspondence with the upper radial electromagnet 104, there is provided an upper radial sensor 107 composed of four electromagnets. Further, the upper radial sensor 107 detects a radial displacement of the main shaft portion 151 of the rotor shaft 113, and transmits a displacement signal to the control device 200.

In the control device 200, the upper radial electromagnet 104 is excitation-controlled through a compensation circuit with a PID adjustment function (not shown) based on the displacement signal obtained through detection by the upper radial sensor 107, thus adjusting the upper radial position of the main shaft portion 151 of the rotor shaft 113. Note that this adjustment is conducted independently in the X-axis direction and the Y-axis direction.

Further, the lower radial electromagnet 105 and a lower radial sensor 108 are arranged in the same way as the upper radial electromagnet 104 and the upper radial sensor 107, adjusting the lower radial position of the main shaft portion 151 of the rotor shaft 113 in the same manner as the upper radial position thereof.

Further, axial electromagnets 106A and 106B are arranged so as to sandwich from above and below a circular metal disc 111 provided in the lower portion of the main shaft portion 151 of the rotor shaft 113. The metal disc 111 is formed of a high magnetic-permeability material, such as iron.

Further, under the metal disc 111, there is provided an axial sensor 109 for detecting an axial displacement of the rotor shaft 113. An axial displacement signal obtained through detection by the axial sensor 109 is transmitted to the control device 200.

Based on the displacement signal obtained through detection by the axial sensor 109, the control device 200 excitation-controls the axial electromagnets 106A and 106B. At this time, the axial electromagnet 106A attracts the metal disc 111 upwardly by magnetic force, and the axial electromagnet 106B attracts the metal disc 111 downwardly.

In this way, the magnetic bearing appropriately adjusts the magnetic force applied to the rotor shaft 113, thereby magnetically levitating the rotor shaft 113 and retaining it in a non-contact fashion.

Further, there is provided a motor 121, which is equipped with a plurality of permanent magnet magnetic poles circumferentially arranged on the rotor side thereof so as to surround the main shaft portion 151 of the rotor shaft 113. A torque component rotating the rotor shaft 113 is applied to those permanent magnet magnetic poles from the electromagnets on the stator side of the motor 121, thereby rotating the rotor 103.

Further, the motor 121 is equipped with an RPM sensor and a motor temperature detecting sensor (not shown). The RPM of the rotor shaft 113 is controlled by the control device 200 on the basis of detection signals received from the RPM sensor and the motor temperature detecting sensor.

On the other hand, arranged on the rotor 103 to which the rotor shaft 113 is fixed are the rotary vanes 102*a*, 102*b*,

102*c*, . . . , in a number of stages as described above. Further, there are arranged a plurality of stationary vanes 123*a*, 123*b*, 123*c*, . . . , with a slight gap being between them and the rotary vanes 102*a*, 102*b*, 102*c*, . . . .

Further, in order to downwardly transfer the molecules of the exhaust gas through collision, the rotary vanes 102*a*, 102*b*, 102*c*, . . . are inclined by a predetermined angle with respect to planes perpendicular to the axis of the rotor shaft 113. In a similar fashion, the stationary vanes 123 are inclined by a predetermined angle with respect to planes perpendicular to the axis of the rotor shaft 113, and are arranged so as to protrude toward the interior of the outer cylinder 127 and in alternate stages with the rotary vanes 102.

Further, one ends of the stationary vanes 123 are supported while being inserted between a plurality of stationary vane spacers 125*a*, 125*b*, 125*c*, . . . stacked together. The stationary vane spacers 125 are ring-like members formed of a metal, such as aluminum, iron, stainless steel, or copper, or a metal such as an alloy containing those metals as the components.

Further, in the outer periphery of the stationary vane spacers 125, the outer cylinder 127 is provided with a slight gap therebetween. The outer cylinder 127 is fixed to a base portion 129 provided at the bottom thereof by bolts 128. Between the bottom of the stationary vane spacers 125 and the base portion 129, there is provided a threaded spacer 131. In the portion of the base portion 129 which is below the threaded spacer 131, there is formed an exhaust port 133, which communicates with the exterior.

The threaded spacer 131 is a cylindrical member formed of a metal, such as aluminum, copper, stainless steel, or iron, or a metal such as an alloy containing those metals as the components, and has on the inner peripheral surface thereof a plurality of spiral thread grooves 131*a* formed therein. The direction of the spiral thread grooves 131*a* is determined such that, when the molecules of the exhaust gas move in the rotating direction of the rotor 103, these molecules are transferred toward the exhaust port 133.

Further, in the lowermost portion of the rotor 103 connected to the blade-like rotary vanes 102*a*, 102*b*, 102*c*, . . . , there is provided the rotary vane 102*d* vertically downwards, which is formed in a cylindrical shape with respect to the axis of the rotor shaft 113. The rotary vane 102*d* protrudes toward the inner peripheral surface of the threaded spacer 131. This protruding part is placed in close proximity to the threaded spacer 131 with a predetermined gap therebetween.

Further, the base portion 129 is a disc-like member constituting the base portion of the turbo molecular pump main body 100, and is generally formed of a metal, such as iron, aluminum, or stainless steel. The base portion 129 physically retains the turbo molecular pump main body 100, and also functions as a heat conduction path, so it is desirable to use a metal that is rigid and of high heat conductivity, such as iron, aluminum, or copper, for the base portion 129.

When, with this construction, the rotor shaft 113 is driven by the motor 121 and rotates together with the rotor 103 and the rotary vanes 102, an exhaust gas from a chamber is sucked through the inlet port 101 by the action of the rotary vanes 102 and the stationary vanes 123.

Then, the exhaust gas sucked in through the inlet port 101 flows between the rotary vanes 102 and the stationary vanes 123 to be transferred to the base portion 129. At this time, the temperature of the rotary vanes 102 rises due to the friction heat generated when the exhaust gas comes into contact with the rotary vanes 102, conduction of the heat generated in the motor 121, etc, and this heat is transmitted to the stationary vanes 123 side by radiation or conduction due to the gas molecules, etc. of the exhaust gas. Further, the stationary vane spacers 125 are bonded together in the outer periphery, and transmit to the exterior the heat received by the stationary vanes 123 from the rotary vanes 102, the friction heat generated when the exhaust gas comes into contact with the stationary vanes 123, etc.

The exhaust gas transferred to the base portion 129 is sent to the exhaust port 133 while being guided by the thread grooves 131*a* of the threaded spacer 131.

In the above-described example, the threaded spacer 131 is provided in the outer periphery of the rotary vane 102*d*, and the thread grooves 131*a* are formed in the inner peripheral surface of the threaded spacer 131. However, conversely to the above, the thread grooves may be formed in the outer peripheral surfaces of the rotary vane 102*d*, and a spacer with a cylindrical inner peripheral surface may be arranged in the periphery thereof.

Further, in order that the gas sucked in through the inlet port 101 may not enter the electrical section formed of the motor 121, the lower radial electromagnet 105, the lower radial sensor 108, the upper radial electromagnet 104, the upper radial sensor 107, etc., the periphery of the electrical section is covered with a stator column 122, and a predetermined pressure is maintained in the interior of the electrical section with a purge gas.

For this purpose, piping (not shown) is arranged in the base portion 129, and the purge gas is introduced through the piping. The purge gas thus introduced flows through the gaps between a protective bearing 120 and the rotor shaft 113, between the rotor and stator of the motor 121, and between the stator column 122 and the rotary vanes 102 before being transmitted to the exhaust port 133.

Incidentally, for enhanced reactivity, the process gas may be introduced into the chamber in a high temperature state. When it reaches a certain temperature by being cooled at the time of evacuation, such process gas may be solidified to precipitate a product in the exhaust system. Then, when such process gas is cooled and solidified in the turbo molecular pump main body 100, it adheres to the inner portion of the turbo molecular pump main body 100 and is deposited thereon.

For example, when $SiCl_4$ is used as the process gas in an Al etching apparatus, a solid product (e.g., $AlCl_3$) is precipitated when the apparatus is in a low vacuum state (760 [torr] to $10^{-2}$[torr]) and at lower temperature (approximately 20[° C.]), and adheres to and is deposited on the inner portion of the turbo molecular pump main body 100 as can be seen from a vapor pressure curve.

When precipitate of the process gas is deposited on the inner portion of the turbo molecular pump main body 100, the deposit narrows the pump flow path, which leads to a deterioration in the performance of the turbo molecular pump main body 100. For example, the above-mentioned product is likely to solidify and adhere to the portion near the exhaust port where the temperature is low, in particular, near the rotary vanes 102 and the threaded spacer 131.

To solve this problem, there has been conventionally adopted a control system (hereinafter referred to as TMS; temperature management system), in which a heater (not shown) and an annular water cooling tube 149 are wound around the outer periphery of the base portion 129 or the like, and in which a temperature sensor (e.g., a thermistor) (not shown) is embedded, for example, in the base portion 129, the heating by the heater and the cooling by the water cooling tube 149 being controlled based on a signal from the temperature sensor so as to maintain the base portion 129 at a fixed, high temperature (set temperature).

Here, the conventional structure of the portion where the rotor shaft 113 and the rotor 103 are fixed to each other will be described. FIG. 10 is an enlarged structural view of the portion where the rotor shaft and the rotor are fixed to each other, FIG. 11 is a partial structural view of the rotor, and FIG. 12 is a partial structural view of the rotor shaft. FIG. 12(*a*) is a longitudinal sectional view of the rotor shaft, and FIG. 12(*b*) is a plan view of the same.

As shown in FIGS. 10 through 12, in the rotor shaft 113, on top of the main shaft portion 151 whose radial position is adjusted by the above-mentioned upper radial electromagnet 104, etc., there is formed a fastening portion 153 whose diameter is increased step wise up to approximately double the diameter of the main shaft portion 151. Over the entire upper surface of the fastening portion 153, there is formed a rotor shaft 113 side contact surface 157 to be brought into contact with the rotor 103, and the contact surface 157 is machined so as to be perpendicular to the axial direction of the main shaft portion 151 and as to be flat.

Further, in the fastening portion 153, there are formed bolt holes 161 open on the contact surface 157 side and extending in an axial direction, and the bolt holes 161 are formed at positions spaced apart from the axis of the rotor shaft 113 by a distance substantially the same as the radius of the main shaft portion 151. Further, the bolt holes 161 are formed, for example, at six positions in the fastening portion 153, and arranged at equal intervals around the axis. The number of the bolt holes 161 is not restricted to six; it may also be, for example, eight.

Further, extending upwardly from the fastening portion 153 of the rotor shaft 113 is a pass-through shaft portion 155 whose diameter is smaller than that of the main shaft portion 151 and whose axis is matched with that of the main shaft portion 151. Further, in the upper end portion of the pass-through shaft portion 155, there is formed a hexagonal hole 163 upwardly open and extending in an axial direction. The hexagonal hole 163 extends to a depth corresponding to approximately half the length of the pass-through shaft portion 155.

On the other hand, in the central portion of the upper end of the rotor 103, there is formed a downwardly extending recess 181 with around sectional configuration. At the center of the recess 181, there is formed a central hole 183 axially extending between the inner side and the outer side of the rotor 103.

Further, below the recess 181 and on the surface on the inner side of the rotor 103, there is formed a rotor 103 side contact surface 187 to be brought into contact with the contact surface 157 of the rotor shaft 113. The contact surface 187 is also machined so as to be perpendicular to the axial direction.

Further, in the recess 181, there are formed bolt passing holes 185 adjacent to the central hole 183 and extending axially between the inner side and the outer side of the rotor 103. The bolt passing holes 185 are formed in the same number as the bolt holes 161 on the rotor shaft 113 side, and are arranged so as to communicate with the bolt holes 161 when the pass-through shaft portion 155 of the rotor shaft 113 is passed through the central hole 183 of the rotor 103.

Further, in the state in which the bolt passing holes 185 communicate with the bolt holes 161, the leg portions of bolts 191 are passed through the bolt passing holes 185; further, the bolts 191 are threadedly engaged with the bolt holes 161 on the rotor shaft 113 side. The bolts 191 are also prepared in the same number as the bolt holes 161.

With this construction, when fixing the rotor shaft 113 and the rotor 103 to each other, the pass-through shaft portion 155 of the rotor shaft 113 is first inserted into the central hole 183 of the rotor 103. At this time, the insertion of the pass-through shaft portion 155 into the central hole 183 is effected, for example, by shrinkage fit.

Thus, at room temperature, the outer diameter of the pass-through shaft portion 155 of the rotor shaft 113 is larger than the inner diameter of the central hole 183 of the rotor 103 by approximately several tens of μm. Prior to the insertion of the pass-through shaft portion 155, solely the rotor 103 is heated to approximately 100° C., and the inner diameter of the central hole 183 of the rotor 103 is made larger than the outer diameter of the pass-through shaft portion 155 of the rotor shaft 113 by approximately several hundreds of μm. After this, the pass-through shaft portion 155 is inserted into the central hole 183 in this state, and left to stand for a fixed period of time for cooling. As a result, when the rotor 103 and the rotor shaft 113 are restored to room temperature, the pass-through shaft portion 155 is firmly fixed to the central hole 183 due to the difference in diameter at room temperature.

After the cooling of the rotor 103 and the rotor shaft 113 fixed to each other by shrinkage fit, the bolts 191 are threadedly engaged with the bolt holes 161 on the rotor shaft 113 side. In fastening the bolts 191, a hexagonal wrench (not shown) is fittingly engaged with the hexagonal hole 163 of the rotor shaft 113, thereby preventing rotation of the rotor 103 and the rotor shaft 113. As a result, the rotor 103 and the rotor shaft 113 are easily fastened together.

DISCLOSURE OF THE INVENTION

Problems to be Solved by the Invention

In such a turbo molecular pump, a corrosive gas may be sucked in. Thus, to prevent corrosion, plating treatment is effected on the entire surfaces of the rotor 103 and the rotary vanes 102. As the plating treatment, there is adopted electroless nickel plating, for example.

When the rotor 103 and the rotary vanes 102 are plated, dripping may occur at the edge portions, etc. of the members as the plating is dried, resulting in formation of plating protuberances. FIG. 13 (which is a partial enlarged view of the portion A of FIG. 10) shows how plating protuberances are formed, for example, on the contact surfaces 157 and 187 of the rotor shaft 113 and the rotor 103. On the contact surface 187 of the rotor 103, dripping has occurred at an edge portion B1 nearest to the pass-through shaft portion 155 of the rotor shaft 113, at an edge portion B2 of the bolt passing hole 185 near the axis of the rotor shaft 113, and at an edge portion B3 of the bolt passing hole 185 on the opposite side of the edge portion B2, resulting in formation of plating protuberances.

Although, the plating protuberances are usually as small as approximately 30 μm, as shown in FIG. 13, when they are formed on the contact surfaces 157 and 187 of the rotor shaft 113 and the rotor 103, the contact surfaces 157 and 187 are not brought into intimate contact with each other, and there is a fear of the contact state of the rotor shaft 113 and the rotor 103 becoming unstable. Thus, the run-out of the rotor shaft 113 and the rotor 103 during rotation increases to make it impossible to maintain the rotation balance, so there is a fear of the turbo molecular pump main body 100 oscillating.

Further, depending upon the protuberance amount of the plating, the contact state of the rotor shaft 113 and the rotor 103 varies, so there is a fear of the natural frequency of the rotor shaft 113 and the rotor 103 fluctuating to a large degree. Usually, a feedback loop is formed in a magnetic bearing (which is formed by the upper radial electromagnet 104, the upper radial sensor 107, the lower radial electromagnet 105, the lower radial sensor 108, the axial electromagnets 106A and 106B, the axial sensor 109, the control device 200, etc. mentioned above), and this feedback loop is equipped with a filter for stabilization. When the natural frequency of the rotor shaft 113 and the rotor 103 fluctuates, the cutoff frequency of the filter is exceeded, and there is a fear of the magnetic bearing oscillating.

In addition, the pass-through shaft portion 155 of the rotor shaft 113 is inserted into and fixed to the central hole 183 of the rotor 103 by shrinkage fit. If the directions of the pass-through shaft portion 155 and the central hole 183 are distorted with respect to the axial direction, play is generated in the rotor shaft 113 and the rotor 103 halfway through the cooling in the shrinkage fit, so there is a fear of the axial directions of the rotor shaft 113 and the rotor 103 being deviated after the cooling. Thus, even by the fastening of the bolts 191, the contact surface 157 and the contact surface 187 are not brought into intimate contact with each other, and there is a fear of the contact state of the rotor shaft 113 and the rotor 103 becoming unstable.

In this regard, it might be possible to fasten the bolts 191 halfway through the cooling in the shrinkage fit. However, it is difficult to make the fastening force for the six bolts 191 even, and, due to this unevenness in fastening force, there is a fear of the axial direction of the central hole 183 and the axial direction of the pass-through shaft portion 155 being deviated from each other. Thus, there is a fear of the contact state of the rotor shaft 113 and the rotor 103 becoming unstable.

The present invention has been made in view of the above problems in the prior art. It is an object of the present invention to provide a fixing structure for fixing a rotor to a rotor shaft, in which the contact state of the contact surfaces of the rotor shaft and the rotor is stabilized to thereby maintain the rotation balance of the rotor shaft and the rotor, making it possible to prevent oscillation, and to a turbo molecular pump having such a fixing structure.

Means for Solving the Problems

Thus, the present invention provides a fixing structure for fixing a rotor to a rotor shaft, including: a rotor; a rotor shaft fixed to the rotor; a bolt hole for fastening the rotor shaft and the rotor to each other; fastening means for fastening the rotor shaft and the rotor to each other by using the bolt hole; a rotor side contact surface formed on a rotor side so that the rotor side contact surface is perpendicular to an axial direction; a rotor shaft side contact surface formed on a rotor shaft side and held in contact with the rotor side contact surface; and a spot facing portion recessed from the rotor shaft side contact surface, characterized in that: a gap is formed between the rotor side contact surface and the spot facing portion as a result of the fastening; and the bolt hole is open on the gap.

To prevent corrosion, plating treatment may be performed on the entire surface of the rotor. In drying the plating, dripping may occur in bolt hole edge portions, etc., resulting in formation of plating protuberances.

In view of this, a gap is formed between the rotor side contact surface and the spot facing portion. The bolt holes are open on this gap.

Thus, if plating protuberances are formed on bolt hole edge portions, etc., such protuberances are absorbed by the gap. Thus, solely the rotor side contact surface of the rotor shaft is brought into contact with the rotor side contact surface of the rotor, and the plating protuberances have no influence on the intimate contact between the rotor side contact surface and the rotor shaft side contact surface.

As a result, the contact state of the rotor shaft and the rotor is stabilized, making it possible to maintain the rotation balance of the rotor shaft and the rotor.

Further, the present invention provides a fixing structure for fixing a rotor to a rotor shaft, in which the rotor has a central hole formed at a center of the rotor, and the rotor shaft has a pass-through shaft portion passed through the central hole and a main shaft portion of a larger diameter than the pass-through shaft portion.

With this construction, the rotor shaft can be firmly fixed to the rotor.

Further, the present invention provides a fixing structure for fixing a rotor to a rotor shaft, characterized by further including a female screw formed in the rotor shaft.

Further, the present invention provides a fixing structure for fixing a rotor to a rotor shaft, characterized by further including fixing means which is threadedly engaged with the female screw to axially bias the rotor shaft and to bias the rotor oppositely to the bias direction of the rotor shaft.

The pass-through shaft portion of the rotor shaft may be passed through the central hole of the rotor by shrinkage fit. When the directions of the central hole and the pass-through shaft portion are distorted with respect to the axial direction, there is a fear of play being generated in the rotor shaft and the rotor halfway through the cooling in the shrinkage fit. Further, due to the unevenness in fastening force, when the fastening of the rotor shaft and the rotor is effected halfway through the cooling in the shrinkage fit, there is a fear of the axial direction of the central hole and the axial direction of the pass-through shaft portion being deviated from each other.

In view of this, the female screw is formed in the rotor shaft, and the fixing means is threadedly engaged with the female screw. Thus, due to this fixing means, the rotor shaft and the rotor are biased axially in opposite directions. Thus, the cooling, etc. of the rotor shaft and the rotor is effected, with the rotor shaft and the rotor being matched with each other in axial direction.

As a result, the rotor side contact surface and the rotor shaft side contact surface are brought into intimate contact with each other, so the contact state of the rotor shaft and the rotor is stabilized, making it possible to maintain the rotation balance of the rotor shaft and the rotor.

Further, the present invention provides a turbo molecular pump having a fixing structure for fixing a rotor to a rotor shaft, including a magnetic bearing magnetically levitating the rotor shaft and performing positional adjustment on the rotor shaft in the radial direction and/or the axial direction, characterized in that: the rotor has rotary vanes; and the turbo molecular pump is installed in an associated equipment and sucks a predetermined gas from the associated equipment.

The rotor shaft and the rotor having the above-described fixing structure are mounted in a turbo molecular pump having a magnetic bearing.

Thus, there is involved no fluctuation in the natural frequency of the rotor shaft and the rotor due to unstableness in the contact state of the rotor shaft and the rotor, so it is possible to prevent oscillation of the magnetic bearing.

Further, the present invention provides a turbo molecular pump including: an electrical section including at least a motor; a base portion supporting the electrical section; a rotor shaft rotated by the motor; a rotor to which the rotor shaft is fixed; rotary vanes formed on the rotor; stationary vanes arranged alternately with the rotary vanes; stationary vane spacers for fixing the stationary vanes in position; an outer cylinder containing at least the rotor shaft, the rotor, the rotary vanes, the stationary vanes, and the stationary vane spacers; a female screw formed in the rotor shaft; and threaded-engagement means threadedly engaged with the female screw, characterized in that, by pulling the threaded-engagement means, at least the rotor shaft, the rotor, and the rotary vanes can be separated from the electrical section and the base portion.

The female screw and the threaded-engagement means are used in the dismantling operation when the turbo molecular pump has suffered breakage. At this time, the threaded-engagement means, whereby the rotor shaft, the rotor, the rotary vanes, the stationary vanes, the stationary vane spacers, and the outer cylinder are separated from the electrical section and the base portion.

Thus, by detaching the rotor shaft and the rotor from the components separated from the electrical section and the base portion, the rotary vanes, stationary vanes, and the stationary vane spacers can be torn off on the inner side of the outer cylinder. Further, if the rotary vanes, the stationary vanes, and the stationary vane spacers can be detached, the outer cylinder can be easily detached.

As a result, the operation of dismantling the turbo molecular pump can be conducted efficiently.

Further, the female screw and the threaded-engagement means are also used in the operation of assembling the turbo molecular pump. At this time, by pulling the threaded-engagement means, the rotor shaft, the rotor, and the rotary vanes can be moved easily. Thus, even when the turbo molecular pump is increased in size, these components can be easily mounted to the base portion side, thus making it possible to efficiently perform the operation of assembling the turbo molecular pump.

Further, the present invention relates to a turbo molecular pump characterized in that the threaded-engagement means is an eyebolt.

Thus, the rotor shaft, etc. can be easily pulled solely by hooking a hook of a crane or the like on the eyebolt. Effect of the Invention As described above, according to the present invention, in a fixing structure for fixing a rotor to a rotor shaft, a gap is provided between the rotor side contact surface and the spot facing portion, whereby the contact state of the rotor shaft and the rotor can be stabilized, making it possible to maintain the rotation balance of the rotor shaft and the rotor.

Further, this fixing structure between the rotor shaft and the rotor is provided in a turbo molecular pump having a magnetic bearing, whereby it is possible to prevent fluctuation in the natural frequency of the rotor shaft and the rotor due to unstableness in the contact state of the rotor shaft and the rotor, thereby making it possible to prevent oscillation of the magnetic bearing.

BEST MODE FOR CARRYING OUT THE INVENTION

In the following, an embodiment of the present invention will be described.

FIG. 1 is an enlarged structural view of a portion where a rotor shaft and a rotor are fixed to each other according to an embodiment of the present invention, and FIG. 2 is a partial structural view of the rotor shaft. FIG. 2(*a*) is a longitudinal sectional view of the rotor shaft, and FIG. 2(*b*) is a plan view of the same. The components that are the same as those of FIGS. 9 through 12 are indicated by the same reference symbols, and a description of such components will be omitted.

In FIGS. 1 and 2, as in the prior art, formed in the upper portion of the main shaft portion 151 of a rotor shaft 213 is a fastening portion 253 whose diameter is enlarged stepwise.

On the outer peripheral portion of the upper surface of the fastening portion 253, there is concentrically formed a rotor shaft 213 side contact surface 257 that is to be brought into contact with a contact surface 187 of a rotor 103. More specifically, the contact surface 257 is formed at a position on the outer side of the portion where the conventional bolt holes 161 are formed, and extends to the outermost peripheral edge of the upper surface; it has a radial length, for example, of approximately 5 mm on the upper surface of the fastening portion 253. Further, the contact surface 257 is machined so as to be perpendicular to the axial direction and as to be flat.

Further, in the upper surface of the fastening portion 253, there is formed a spot facing portion 259 recessed from the contact surface 257 and extending from the portion where a pass-through shaft portion 255 is formed to the inner periphery of the contact surface 257. The upper surface of the spot facing portion 259 is also machined so as to be perpendicular to the axial direction. The depth of the spot facing portion 259 is, for example, approximately 50 μm.

Further, in the upper end portion of the pass-through shaft portion 255, there is formed a hexagonal hole 163 which is upwardly open. In addition, at the bottom of the hexagonal hole 163, there is formed a female screw 263 extending in an axial direction. The depth of the female screw 263 is approximately the same as the length of the pass-through shaft portion 255.

The positional relationship between the hexagonal hole 163 and the female screw 263 may be reversed, that is, it is possible to form the female screw 263 on the upper side and the hexagonal hole 163 on the lower side. Further, as shown in the drawing, it is desirable to form the female screw 263 in the pass-through shaft portion 255. This is due to the fact that a balancer machine (not shown) is usually provided in a recess 181 at the upper end of the rotor shaft 213; depending upon the position where this balancer machine is provided, there is a fear of the bolts, etc. becoming incapable of being threadedly engaged with the pass-through shaft portion 255.

In addition, in the turbo molecular pump of the present invention, there is provided a fixing component 301 for fixing the rotor shaft 213 to the rotor 103 halfway through the cooling in the shrinkage fit. The fixing component 301 is used when shrinkage fit is performed; during rotation of the rotor shaft 213, it is desirable for the fixing component 301 to be removed in order to maintain the rotation balance of the rotor shaft 213, etc.

FIG. 3 shows how the rotor shaft is fixed by this fixing component, and FIG. 4 shows the construction of the fixing component. FIG. 4(*a*) is a longitudinal sectional view of the fixing component, and FIG. 4(*b*) is a plan view of the fixing component. FIG. 4(*c*) shows another example of the fixing component.

In FIGS. 3 and 4, the fixing component 301 is formed as a cylindrical member with a ceiling. The fixing component 301 is accommodated in the recess 181 of the rotor 103 with a ceiling portion 303 thereof directed upwards. Further, in the state in which it is accommodated in the recess 181, a cylindrical portion 305 of the fixing component 301 contains, inside thereof, the portion of the pass-through shaft portion 255. protruding from the central hole 183 and the openings of the bolt passing holes 185.

At the center of the fixing component 301, there is formed a bolt passing hole 311 extending through the ceiling portion 303. The leg portion of a fixing bolt 321 is passed through the bolt passing hole 311. Further, the fixing bolt 321 is threadedly engaged with the female screw 263 formed in the pass-through shaft portion 255 of the rotor shaft 213.

As a result, through fastening of the fixing bolt 321, the pass-through shaft portion 255 of the rotor shaft 213 is biased axially upwards, and the bottom portion of the recess 181 of the rotor 103 is biased uniformly downwards in the axial direction by the cylindrical portion 305 of the fixing component 301.

Further, around the bolt passing hole 311 of the fixing component 301, there are formed D-shaped bolt insertion holes 313 extending through the ceiling portion 303. The bolt insertion holes 313 are formed in the same number as the bolt holes 161 on the rotor shaft 213 side, and are arranged at equal intervals around the bolt passing hole 311 at the center.

The entire bolts 191 including their head portions threadedly engaged with the bolt holes 161 can be inserted into the bolt insertion holes 313, and the fastening of the bolts 191 can be performed with a driver, etc. inserted into the bolt insertion holes 313. As long as they allow insertion of the entire bolts 191, the configuration of the bolt insertion holes 313 is not restricted to the D-shaped one as shown in FIG. 4(*b*); it may also be a round one as shown in FIG. 4(*c*).

With this construction, when fixing the rotor shaft 213 and the rotor 103 to each other, as in the prior art, the pass-through shaft portion 255 of the rotor shaft 213 is inserted into the central hole 183 of the rotor 103 by shrinkage fit, and after the cooling in this shrinkage fit, the rotor shaft 213 and the rotor 103 are fastened to each other by the bolts 191.

At this time, also in the turbo molecular pump of the present invention, the entire surfaces of the rotor 103 and the rotary vanes 102 are plated to prevent corrosion. Also during the drying of this plating, plating protuberances may be formed on the contact surface 187 of the rotor 103.

FIG. 5 (which is a partially enlarged view of the portion C of FIG. 1) shows how such plating protuberances are formed. As in the prior art, on the contact surface 187 of the rotor 103, dripping occurs at an edge portion B1 nearest to the pass-through shaft portion 255, and edge portions B2 and B3 of the bolt passing hole 185 to form plating protuberances.

However, in the rotor shaft 213 of the present invention, there is formed, on the upper surface of the fastening portion 253 thereof, the spot facing portion 259, whose upper surface is recessed from the contact surface 257. Thus, at the portion where the spot facing portion 259 is formed, there is formed, between the contact surface 187 of the rotor 103 and the spot facing portion 259, a gap 265 of a depth corresponding to the depth of the spot facing portion 259.

In this regard, the spot facing portion 259 is formed to extend from the pass-through shaft portion 255 to a position on the outer side of the portion where the bolt holes 161 are formed (that is, the bolt holes 161 are open on the gap 265), so even when plating protuberances are formed at the edge portions B1 through B3 of the contact surface 187 of the rotor 103, such protuberances are all absorbed by the gap 265.

Thus, exclusively the contact surface 257 of the rotor shaft 213 comes into contact with the contact surface 187 of the rotor 103, and the plating protuberances have no influence on the intimate contact between the contact surface 257 and the contact surface 187. Thus, the contact state of the rotor shaft 213 and the rotor 103 is stabilized.

In addition, in the present invention also, when the directions of the pass-through shaft portion 255 and the central hole 183 are distorted with respect to the axial direction, there is a fear of play being generated on the rotor shaft 213 and the rotor 103 halfway through the cooling in the shrinkage fit.

However, the turbo molecular pump of the present invention has the fixing component 301. Thus, by using the fixing component 301 in the cooling in the shrinkage fit, it is possible to fix the rotor shaft 213 to the rotor 103.

At this time, the rotor shaft 213 is upwardly biased in the axial direction, and the rotor 103 is downwardly biased in the axial direction by the fixing component 301. Thus, even when the directions of the pass-through shaft portion 255 and the central hole 183 are distorted, the rotor shaft 213 and the rotor 103 are cooled, with the axial directions of the rotor shaft 213 and the rotor 103 being matched with each other. Thus, the contact surface 257 and the contact surface 187 are brought into intimate contact with each other, and the contact state of the rotor shaft 213 and the rotor 103 is stabilized.

To achieve a reduction in production process, etc., it will also be possible to effect fastening of the bolts 191 halfway through the cooling in the shrinkage fit. In this case also, it is possible to fix the rotor shaft 213 to the rotor 103 by using the fixing component 301.

In this regard, the bolt insertion holes 313 are formed in the ceiling portion 303 of the fixing component 301, so it is possible to effect fastening of the bolts 191, with the rotor shaft 213 being fixed by the fixing component 301. Further, in this case, there is involved the problem of unevenness in the fastening force for the six bolts 191. However, since the rotor shaft 213 is fixed to the rotor 103, the influence of the unevenness in fastening force is minimized. Thus, the contact state of the rotor shaft 213 and the rotor 103 is stabilized.

With the above-described construction, it is possible to stabilize the contact state of the rotor shaft 213 and the rotor 103, so it is possible to maintain the rotation balance of the rotor shaft 213 and the rotor 103. Thus, it is possible to prevent oscillation of the turbo molecular pump. Further, there is involved no fluctuation in the natural frequency of the rotor shaft 213 and the rotor 103 due to unstableness of the contact state, so it is possible to prevent oscillation of the magnetic bearing.

While in the above description of the present invention the central hole 183 is formed in the rotor 103, and the pass-through shaft portion 255 of the rotor shaft 213 is passed through and fixed to the central hole 183, this should not be construed restrictively. For example, it is also possible to fittingly engage the rotor shaft with the rotor for fixation.

FIG. 6 is an enlarged structural view of the portion where the rotor shaft and the rotor are fixed to each other.

In FIG. 6, unlike the rotor shaft 213 of FIG. 1, a rotor shaft 613 is equipped with no pass-through shaft portion 255. Further, unlike the rotor 103 of FIG. 1, a rotor 503 has no central hole 183.

As in the rotor shaft 213 of FIG. 1, a spot facing portion 659 is formed in the upper surface of a fastening portion 653 of the rotor shaft 613 and on the inner peripheral side of the contact surface 257. Further, the contact surface 187 of the rotor 503 has a recess 581 extending upwardly from the inner side of the rotor 503.

A maximum diameter portion 653*a* of the fastening portion 653 of the rotor shaft 613 is fittingly engaged with the recess 581. Thus, at the recess 581, the rotor shaft 613 is fixed to the rotor 503, and the contact surface 257 of the rotor shaft 613 and the contact surface 187 of the rotor 503 are held in contact with each other.

With this construction, even when plating protuberances are formed on the contact surface 187 of the rotor 503, since the spot facing portion 659 is formed in the rotor shaft 613, a gap 665 is formed between the rotor 503 and the rotor shaft 613.

Thus, it is possible to stabilize the contact state of the rotor shaft 613 and the rotor 503. As a result, it is possible to select as appropriate a fixing structure between the rotor shaft 613 and the rotor 503 that can be easily designed.

While in the above description of the present invention the female screw 263 formed in the pass-through shaft portion 255 of the rotor shaft 213 is used to fix the fixing component 301, this should not be construed restrictively. That is, it is also possible to use the female screw 263 for the purpose of achieving an improvement in the efficiency of the operation of dismantling the turbo molecular pump.

For example, in the turbo molecular pump shown in FIG. 9, suppose there occurs blade breakage (which refers to a condition in which the rotary vanes 102 collide with the stationary vanes 123 and the stationary vane spacers 125 during rotation and get entangled therewith in a complicated manner to suffer breakage), and the turbo molecular pump suffers destruction. In this case, the turbo molecular pump destroyed is dismantled to investigate the cause of failure.

In the conventional turbo molecular pump, the bolts 128 fastening the outer cylinder 127 are first removed, and then solely the outer cylinder 127 is removed from the turbo molecular pump main body 100. Further, the stationary vane spacers 125 and the stationary vanes 123 are removed sequentially, and then the rotary vanes 102 and the rotor shaft 113 are removed to investigate each component.

However, in the case where the turbo molecular pump incurs blade breakage to suffer destruction, the rotary vanes 102 collide with the stationary vanes 123 and the stationary vane spacers 125 during rotation to suffer breakage, so after the breakage, the rotary vanes 102 are entangled with the stationary vanes 123 and the stationary vane spacers 125 in a complicated manner. Further, as a result of their collision with the stationary vanes 123 and the stationary vane spacers 125, the rotary vanes 102, etc. are sunk into the outer cylinder 127 to deform the outer cylinder 127.

Thus, in reality, it is not easy to remove the outer cylinder 127, and the removal of the outer cylinder 127 is effected, for example, by forcing a bar into the deformed portion, etc. of the outer cylinder 127 while restoring the deformed portion to the former condition. Further, even after the removal of the outer cylinder 127, the rotary vanes 102 have been damaged in a state in which they are entangled with the stationary vanes 123 and the stationary vane spacers 125 in a complicated manner, so it is impossible to remove the rotor 103, the rotor shaft 113, etc. without separating the rotary vanes 102, etc. one by one through manual operation.

As shown in FIG. 7, in the turbo molecular pump of the present invention, when performing the dismantling operation, an eyebolt 401 is threadedly engaged with the female screw 263 of the rotor shaft 213. A hook from a crane or the like (not shown) is hooked on the eyebolt 401.

In this process, the bolts 128 fastening the outer cylinder 127 are removed beforehand. Further, the metal disc 111 provided on the rotor shaft 213 is also removed. Further, the base portion 129 is fixed in position by an instrument (not shown) so that the base portion 129 side may not be raised together with the rotor shaft 213, etc.

After this, the eyebolt 401 is pulled upwardly by a crane or the like, and the rotor shaft 213 is raised.

At this time, the rotor shaft 213 is fixed to the rotor 103, so the rotor 103 is raised together with the rotor shaft 213. Since the rotary vanes 102 have been entangled with the stationary vanes 123 and the stationary vane spacers 125 and damaged, the rotary vanes 102, the stationary vanes 123, and the stationary vane spacers 125 are also raised together with the rotor shaft 213. Further, the rotary vanes 102, etc. are sunk into the outer cylinder 127, so the outer cylinder 127 is also raised together with the rotor shaft 213.

Thus, when the eyebolt 401 is pulled by a crane or the like, the rotor shaft 213, the rotor 103, the rotary vanes 102, the stationary vanes 123, the stationary vane spacers 125, and the outer cylinder 127 (these components will be collectively referred to as upper components 500) are raised integrally. Thus, solely the upper components 500 are separated from the base portion 129 side.

By detaching the rotor shaft 213 and the rotor 103 from the separated upper components 500, it is possible to tear off the rotary vanes 102, the stationary vanes 123, and the stationary vane spacers 125 on the inner side of the outer cylinder 127. This operation is easier to perform than the conventional operation of tearing off the rotary vanes 102, etc. manually one by one. Further, if the rotary vanes 102, the stationary vanes 123, and the stationary vane spacers 125 can be detached, the outer cylinder 127 can be easily detached.

Thus, by using the female screw 263 and the eye bolt 401, it is possible to efficiently perform the operation of dismantling the turbo molecular pump.

It is desirable for the eyebolt 401, which is used when dismantling the turbo molecular pump, to be detached at the time of rotation of the rotor shaft 213 in order to maintain the rotation balance of the rotor shaft 213, etc. The bolt is not restricted to the eyebolt 401. For example, by using a bolt with a spherical head portion, it is possible to maintain the balance of the rotor shaft 213, etc. during rotation, so there is no need to detach the bolt. In this case, when pulling the upper components 500, the head portion of this bolt is grasped by a crane or the like.

In addition, it is also possible to use the female screw 263 and the eye bolt 401 for the operation of assembling the turbo molecular pump.

For example, when, in the turbo molecular pump assembling operation, the rotor shaft 213, the rotor 103, and the rotary vanes 102 are to be mounted to the base portion 129 side, it is necessary to raise the rotor shaft 213, the rotor 103, and the rotary vanes 102 and move them.

However, in the case where the turbo molecular pump is increased in size for a larger capacity in the future, the rotor shaft 213, the rotor 103, and the rotary vanes 102 will also be increased in size, so the weight thereof will be increased. Thus, it may be difficult for the operator to raise the rotor shaft 213, the rotor 103, and the rotary vanes 102 by hand and move them.

In view of this, the eyebolt 401 is threadedly engaged with the female screw 263 of the rotor shaft 213, and the rotor shaft 213, the rotor 103, and the rotary vanes 102 are pulled by a crane or the like, thereby making it possible to easily move the rotor shaft 213, the rotor 103, and the rotary vanes 102 to mount them to the base portion 129 side.

Thus, by using the female screw 263 and the eyebolt 401, it is possible to achieve an improvement in the efficiency of the operation of assembling a large-sized turbo molecular pump.

DESCRIPTION OF SYMBOLS

Figure 1:
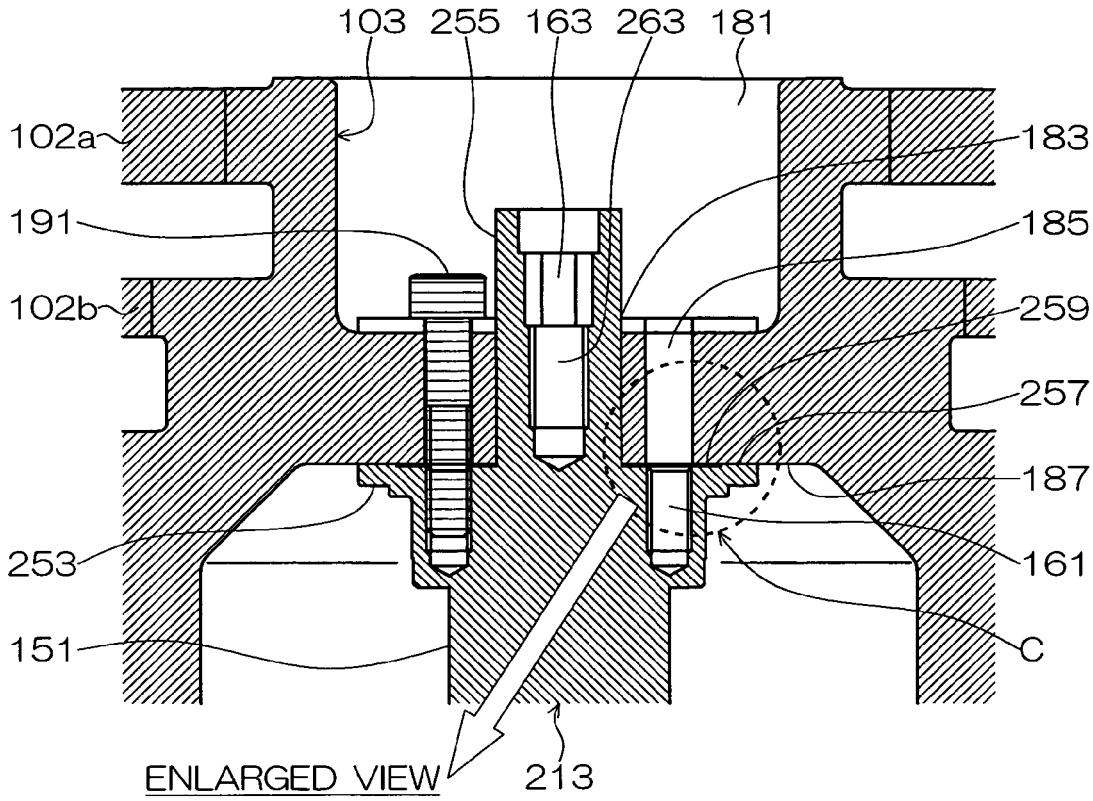
[FIG. 1] An enlarged structural view of a portion where a rotor shaft and a rotor are fixed to each other according to the present invention.
Figure 1:
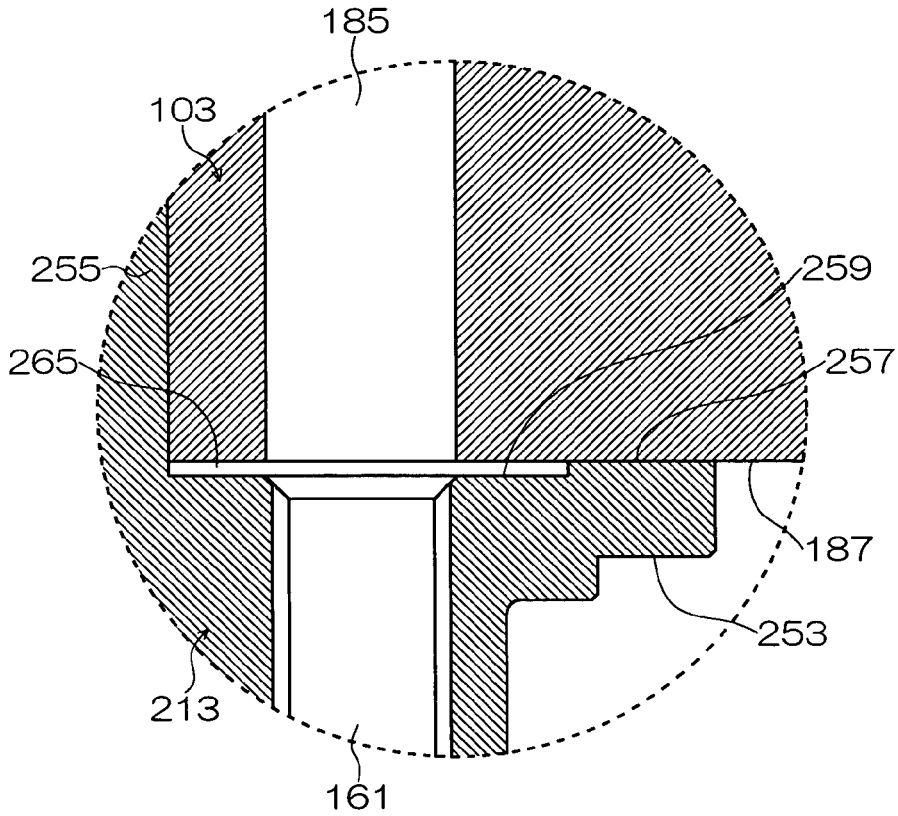
Figure 2:
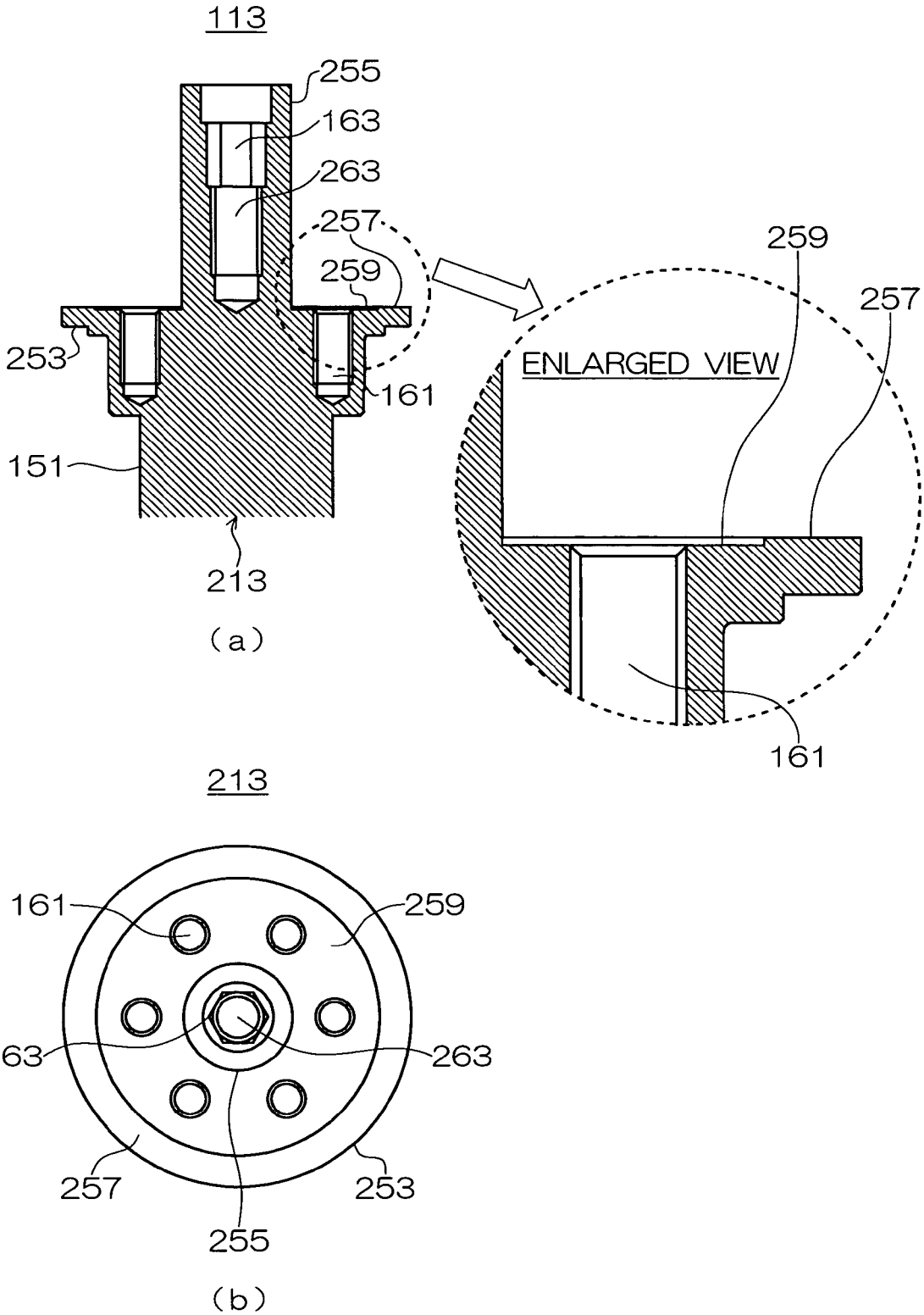
[FIG. 2] A partial structural view of a rotor shaft according to the present invention.
Figure 3:
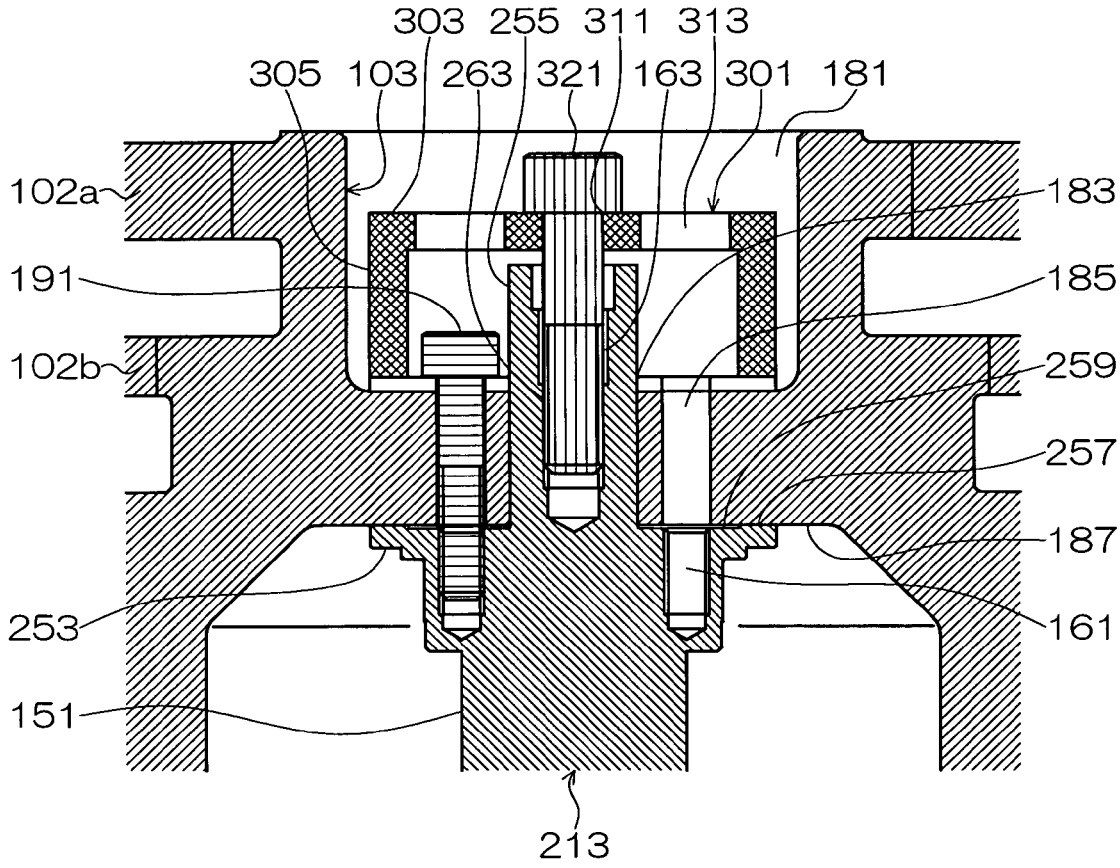
[FIG. 3] A diagram showing how a rotor shaft is fixed by a fixing component according to the present invention.
Figure 4:
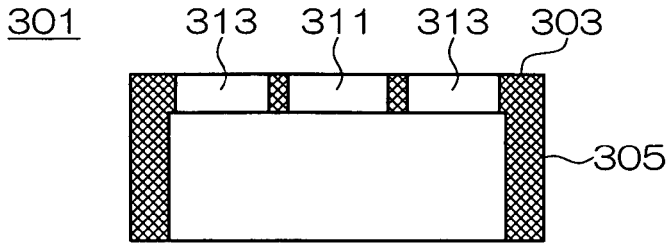
[FIG. 4] A structural view of a fixing component according to the present invention.
Figure 4:
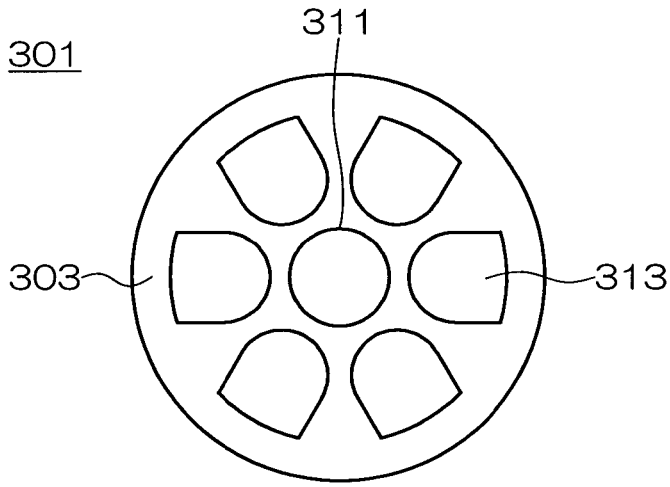
Figure 4:
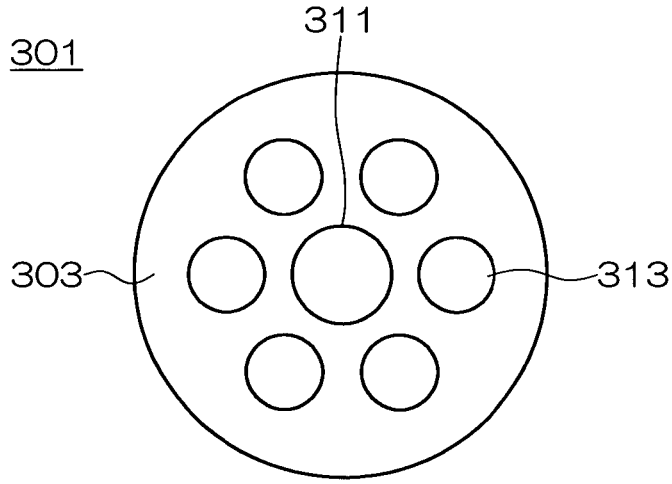
Figure 5:
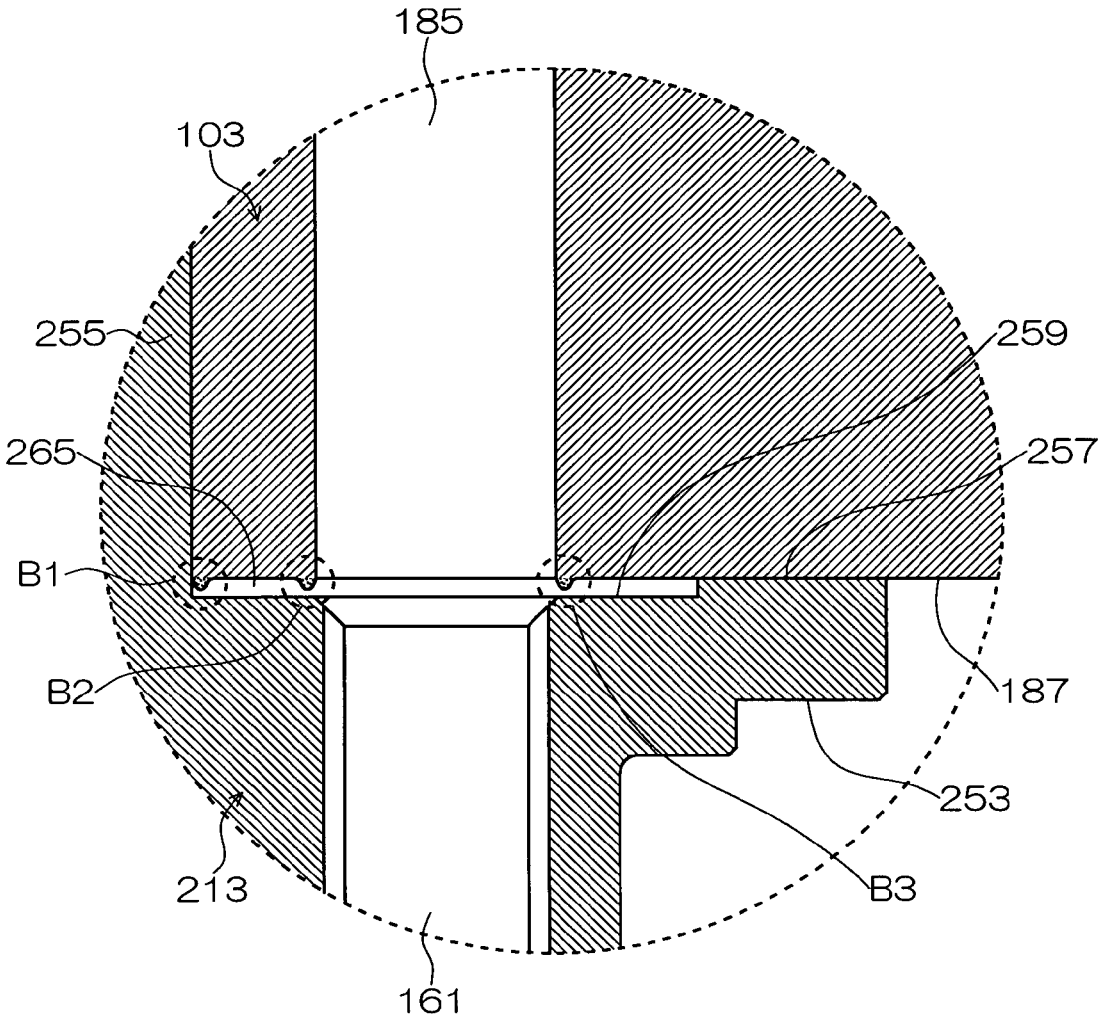
[FIG. 5] A diagram showing how plating protuberances are formed on a contact surface according to the present invention.
Figure 6:
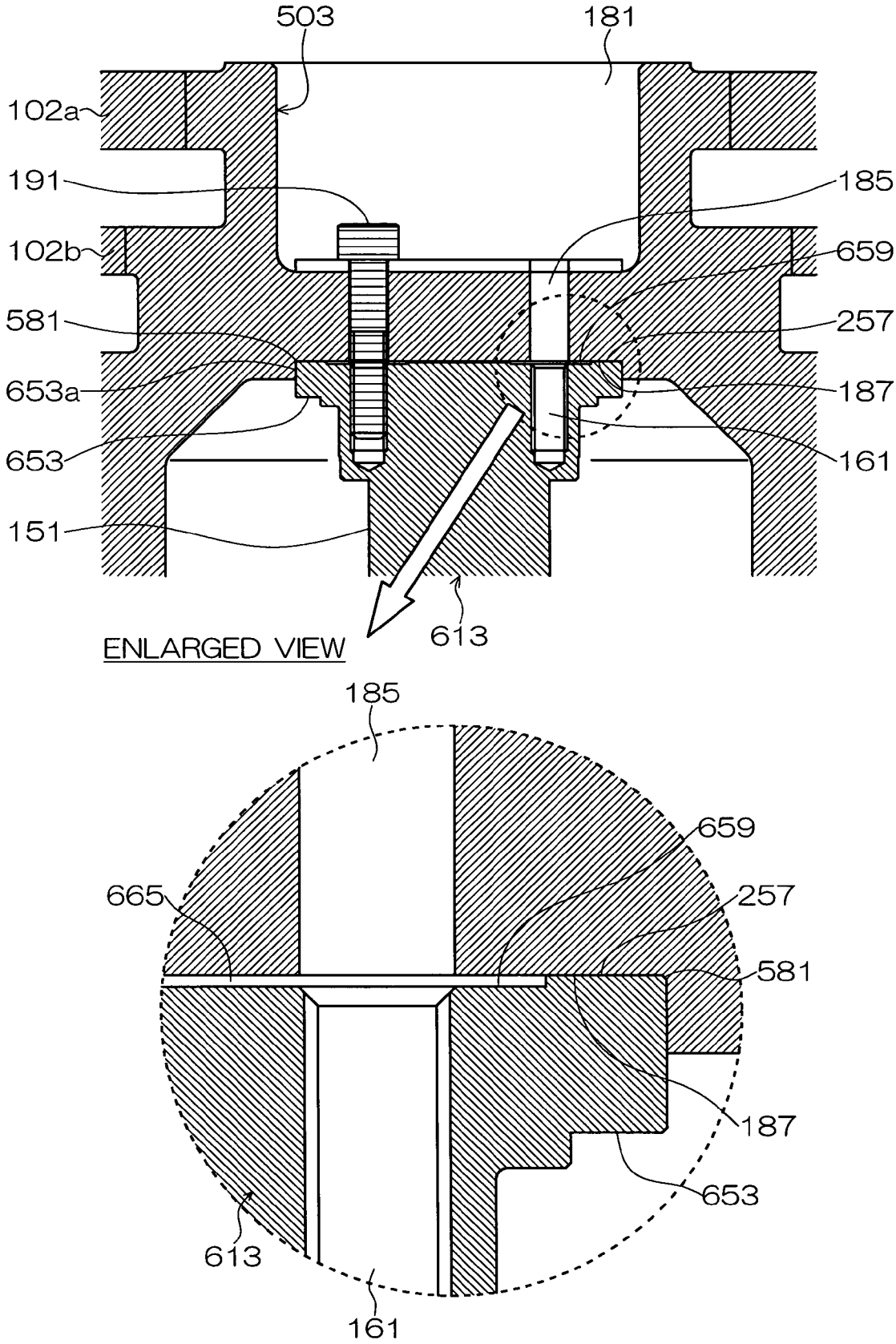
[FIG. 6] An enlarged structural view of a portion where a rotor shaft and a rotor are fixed to each other according to the present invention (another example).
Figure 7:
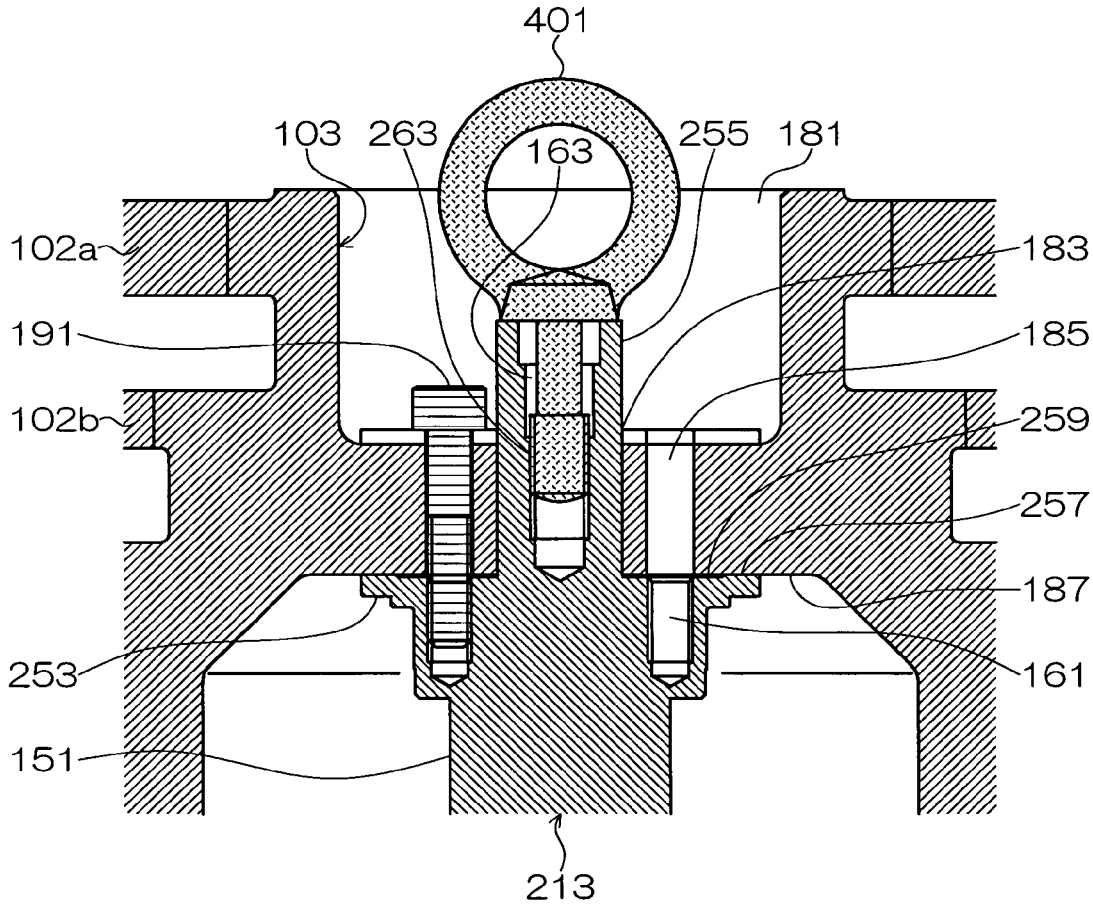
[FIG. 7] A diagram showing another example of how a female screw is used.
Figure 8:
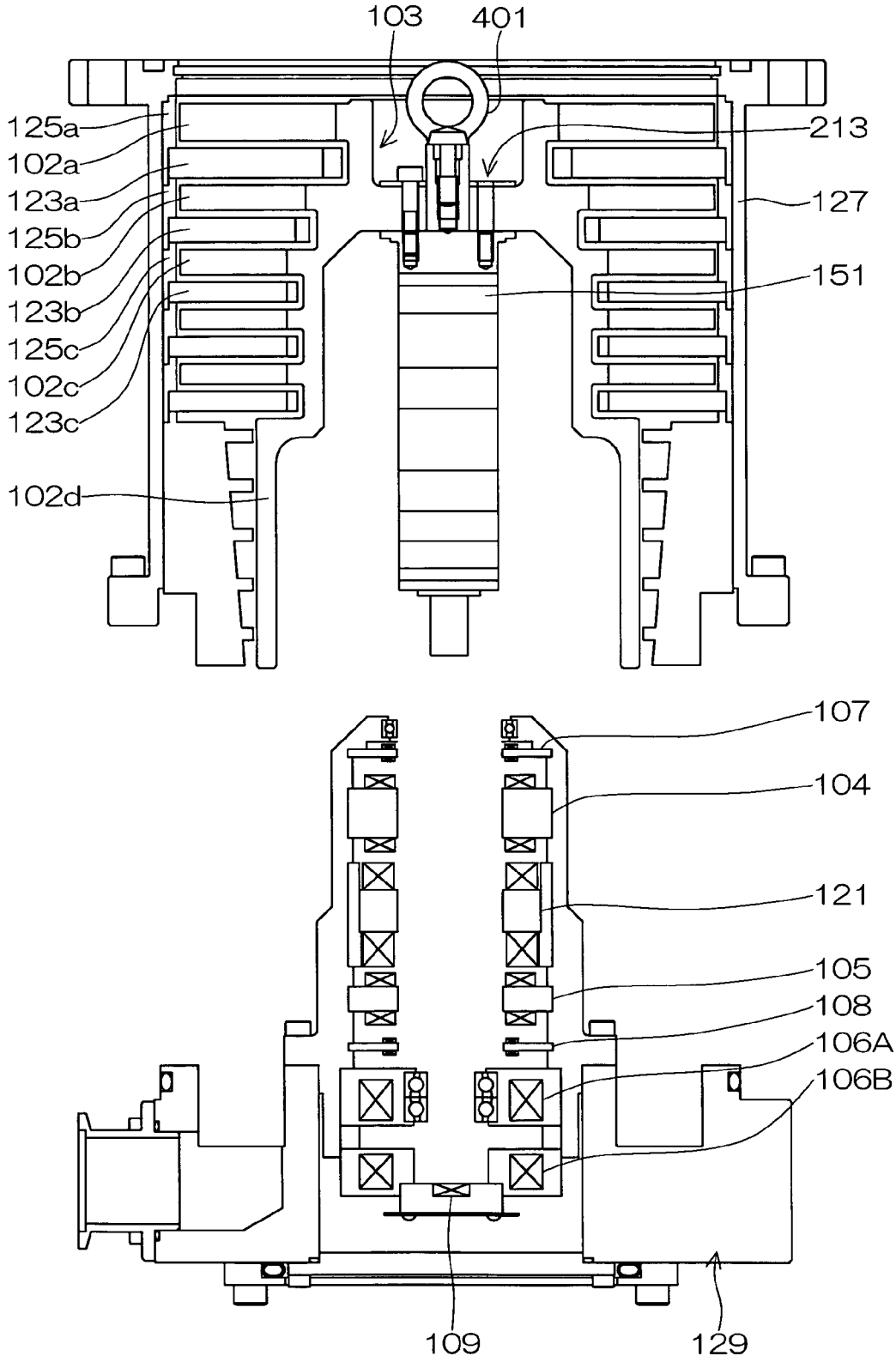
[FIG. 8] Ditto.
Figure 9:
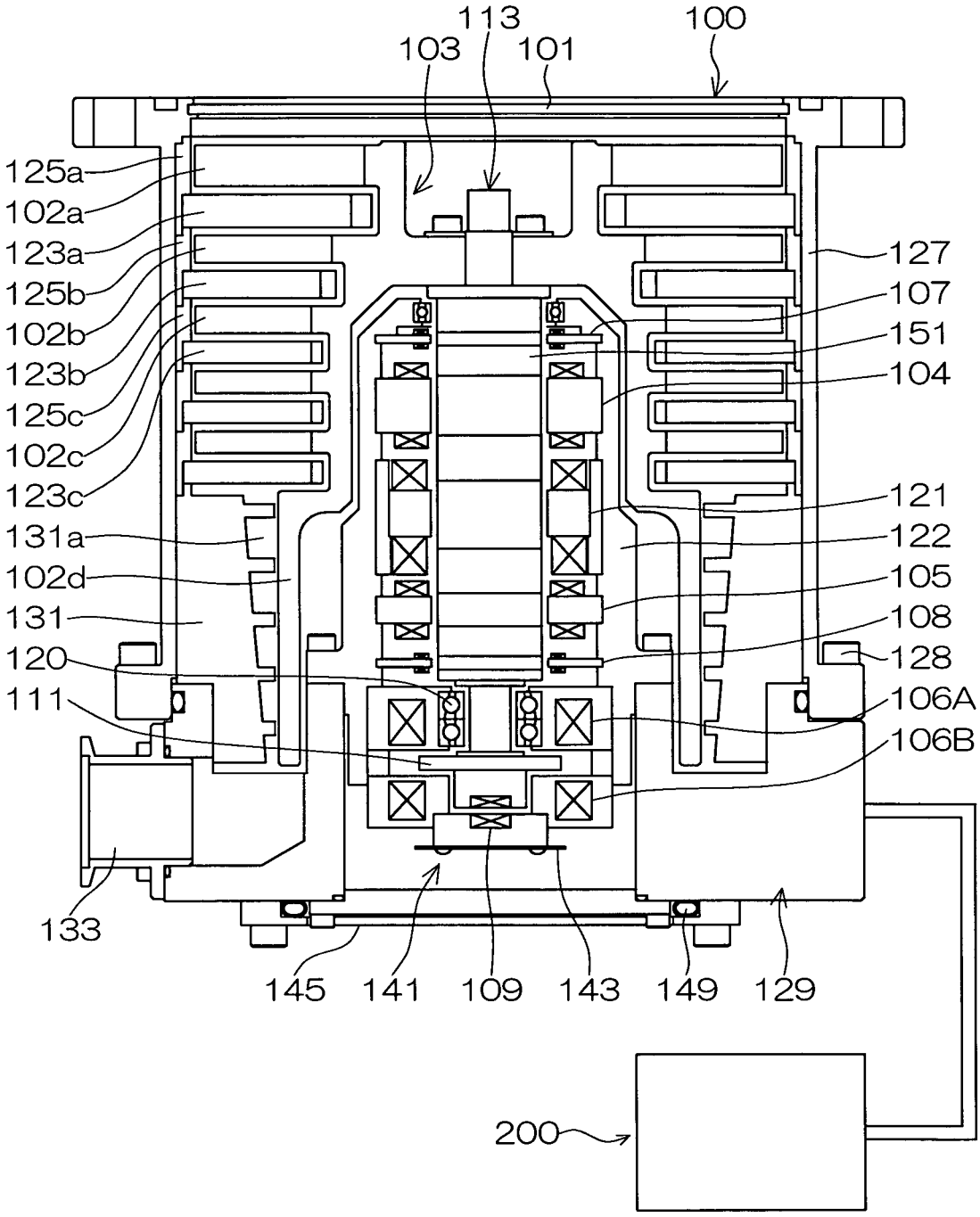
[FIG. 9] A structural view of a conventional turbo molecular pump.
Figure 10:
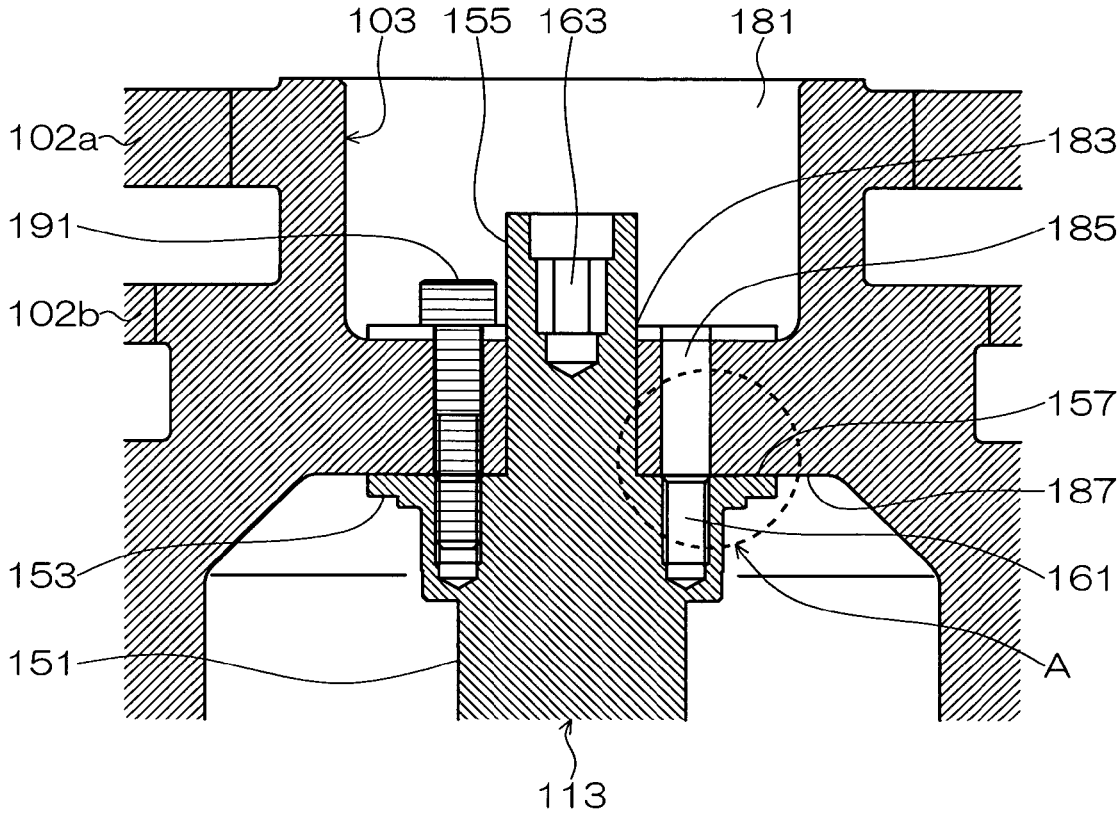
[FIG. 10] An enlarged structural view of a portion where a rotor shaft and a rotor are fixed to each other according to a prior-art technique.
Figure 11:
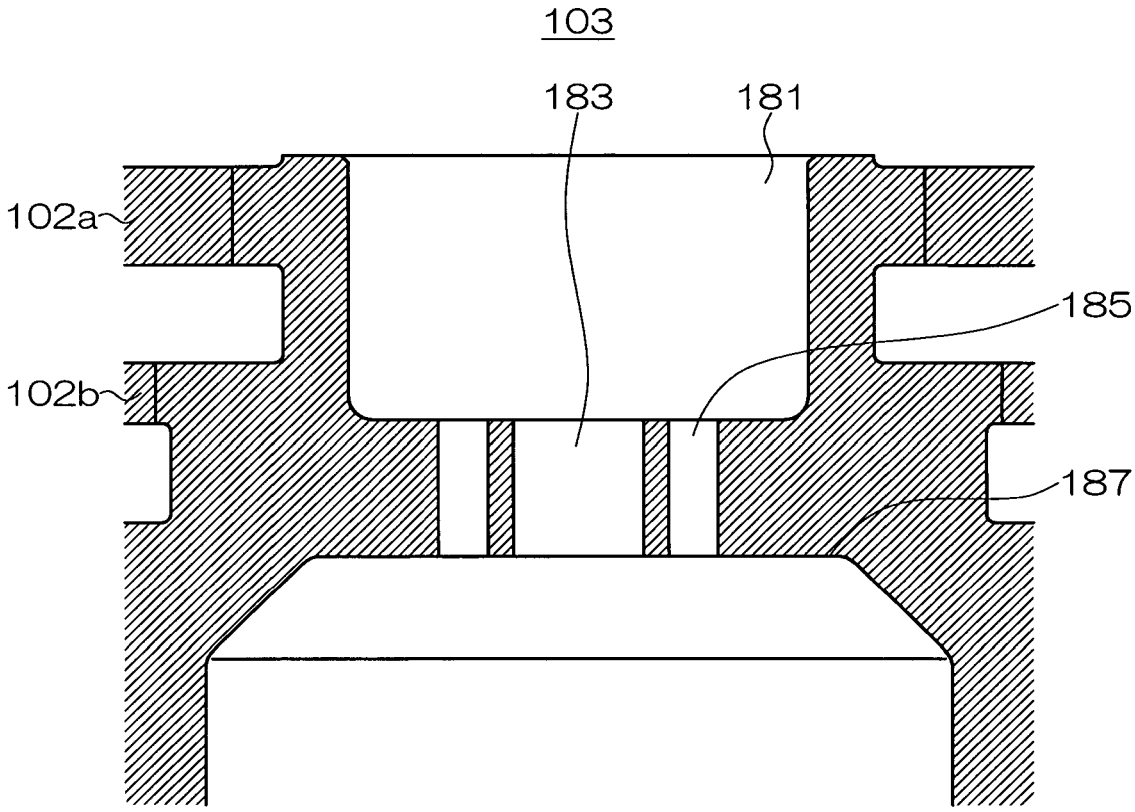
[FIG. 11] A partial structural view of a conventional rotor.
Figure 12:
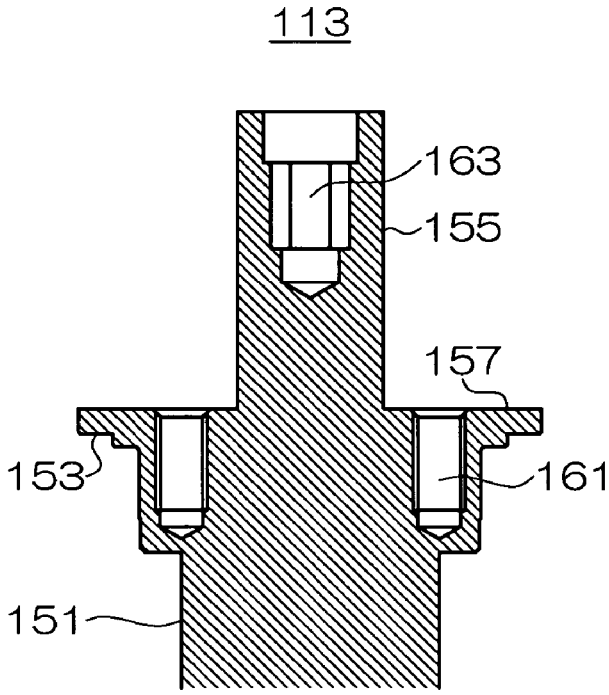
[FIG. 12] A partial structural view of a conventional rotor shaft.
Figure 12:
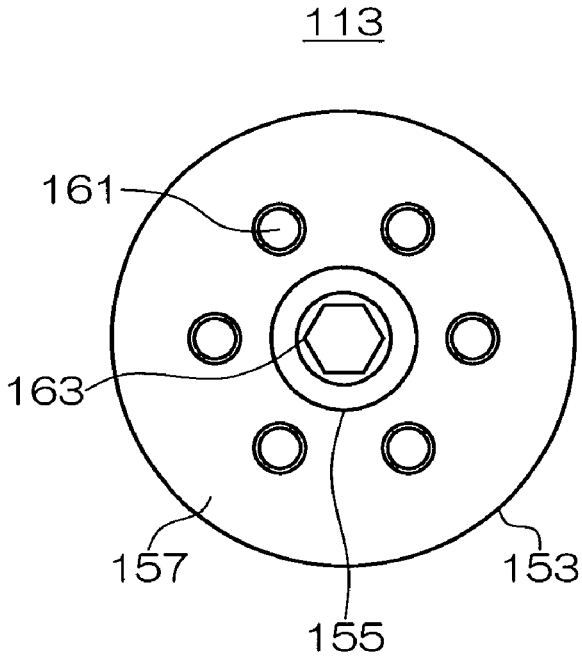
Figure 13:
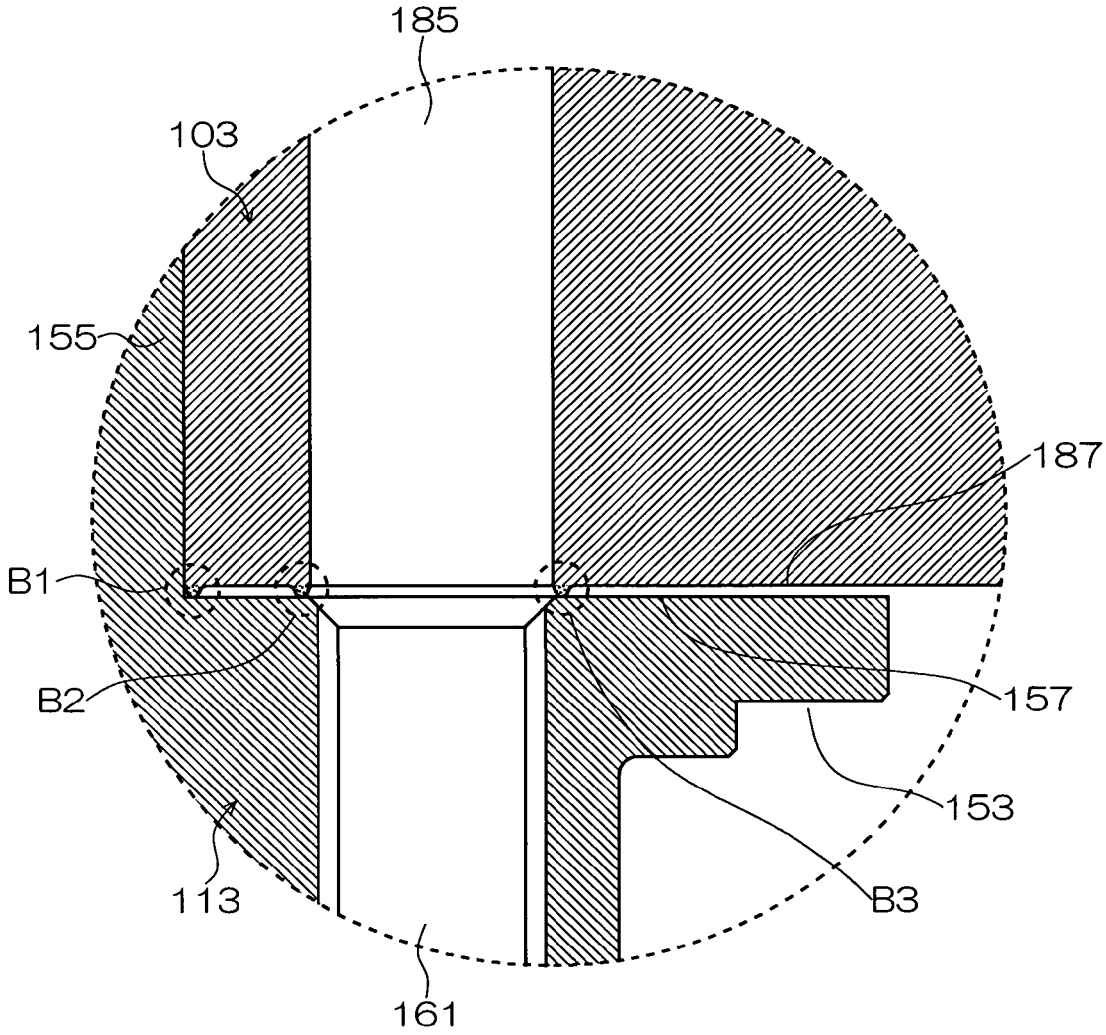
[FIG. 13] A diagram showing how plating protuberances are formed on a contact surface according to the prior-art technique.

100 turbo molecular pump main body
102 rotary vanes
103, 503 rotor
104 upper radial electromagnet
105 lower radial electromagnet
106A, 106B axial electromagnet
107 upper radial sensor
108 lower radial sensor
109 axial sensor
113, 213, 613 rotor shaft
121 motor
123 stationary vanes
125 stationary vane spacers
127 outer cylinder
129 base portion
151 main shaft portion
153, 253, 653 fastening portion
155, 255 pass-through shaft portion
157, 187, 257 contact surface
161 bolt hole
183 central hole
185 bolt passing hole
191 bolt
200 control device
259, 659 spot facing portion
263 female screw
265, 665 gap
301 fixing component
321 fixing bolt
401 eyebolt

The invention claimed is:

1. A fixing structure for fixing a rotor to a rotor shaft, comprising:

a rotor;

a rotor shaft fixed to the rotor;

a bolt hole for fastening the rotor shaft and the rotor to each other;

fastening means for fastening the rotor shaft and the rotor to each other by using the bolt hole;

a rotor side contact surface formed on a rotor side so that the rotor side contact surface is perpendicular to an axial direction;

a rotor shaft side contact surface formed on a rotor shaft side and held in contact with the rotor side contact surface; and a spot facing portion recessed from the rotor shaft side contact surface, characterized in that:

a gap is formed between the rotor side contact surface and the spot facing portion as a result of the fastening; and the bolt hole is open on the gap.

2. A fixing structure for fixing a rotor to a rotor shaft according to claim 1, characterized in that:

the rotor has a central hole formed at a center of the rotor; and the rotor shaft has a pass-through shaft portion passed through the central hole and a main shaft portion of a larger diameter than the pass-through shaft portion.

3. A turbo molecular pump having a fixing structure as claimed in claim 1; comprising a magnetic bearing magnetically levitating the rotor shaft and performing positional adjustment on the rotor shaft in the radial direction and/or the axial direction, characterized in that:

the rotor has rotary vanes; and the turbo molecular pump is installed in an associated equipment and sucks a predetermined gas from the associated equipment.

4. A turbo molecular pump comprising:

an electrical section including at least a motor;

a base portion supporting the electrical section;

a rotor shaft rotated by the motor;

a rotor to which the rotor shaft is fixed;

rotary vanes formed on the rotor;

stationary vanes arranged alternately with the rotary vanes;

stationary vane spacers for fixing the stationary vanes in position;

an outer cylinder containing at least the rotor shaft, the rotor, the rotary vanes, the stationary vanes, and the stationary vane spacers, a female screw formed in the rotor shaft; and threaded-engagement means threadedly engaged with the female screw, characterized in that, by pulling the threaded-engagement means, at least the rotor shaft, the rotor, and the rotary vanes can be separated from the electrical section and the base portion.

5. A turbo molecular pump according to claim 4, characterized in that the threaded-engagement means is an eyebolt.

* * * * *